United States Patent [19]

Kühl et al.

[11] 4,078,665

[45] Mar. 14, 1978

[54] FLOATING CRANE COMPRISING A MAIN JIB WHICH CAN BE DEPOSITED ON DECK

[75] Inventors: Gerhard Kühl, Altenholz-Stift; Uwe Naeve, Kiel-Ellerbek, both of Germany

[73] Assignee: Howaldtswerke-Deutsche Werft Aktiengesellschaft Hamburg und Kiel, Kiel, Germany

[21] Appl. No.: 720,172

[22] Filed: Sep. 2, 1976

[30] Foreign Application Priority Data

Sep. 5, 1975 Germany ..... 2539526

[51] Int. Cl.[2] ..... B66C 23/52

[52] U.S. Cl. ..... 212/3 R; 214/670

[58] Field of Search ..... 212/3 R, 3 A, 8 R, 35 R, 212/54, 58 R; 214/77 R, 660, 670–674

[56] References Cited

U.S. PATENT DOCUMENTS

| | | | |
|---|---|---|---|
| 279,792 | 6/1883 | Paterson | 212/3 X |
| 1,968,684 | 7/1934 | Harvey | 212/3 |

FOREIGN PATENT DOCUMENTS

| | | | |
|---|---|---|---|
| 800,774 | 12/1950 | Germany | 212/3 |
| 383,730 | 11/1932 | United Kingdom | 212/3 |

*Primary Examiner*—Drayton E. Hoffman
*Assistant Examiner*—R. B. Johnson
*Attorney, Agent, or Firm*—John C. Smith, Jr.

[57] ABSTRACT

A floating crane comprises a main jib which can be deposited on deck and luffed by a luffing rope about a hinge working in bearings that can be moved along a horizontal track on the deck of the floating pontoon.

1 Claim, 4 Drawing Figures

FLOATING CRANE COMPRISING A MAIN JIB WHICH CAN BE DEPOSITED ON DECK

BACKGROUND OF THE INVENTION

This invention relates to a floating crane comprising a main jib which can be deposited on deck and luffed by a luffing rope about a hinge working in bearings that can be moved along a horizontal track on the deck of the floating pontoon.

In conventional floating cranes the main jib is deposited on deck for a sea voyage by lowering it aft. This operation takes several hours to perform and calls for the assistance of a corresponding number of men. Being difficult and hazardous it is a fair weather operation. The main jib must first be placed in a given angular position. The jib support must then be unlocked and lowered. Finally, strong rope connections must be established from the mast to hook blocks and deck. This work must be done at a point some 10 meters ahead of the pontoon and about 20 meters above the water from a basket hanging from auxiliary hoisting tackle. The main jib must then be pulled up over dead center by taking in the luffing rope and paying out the hoisting rope and thus depositing the jib on a chair by lowering it aft.

SUMMARY OF THE INVENTION

It is therefore the object of the present invention to provide a method of depositing the jib which is so devised that it can be performed safely and quickly when foul weather threatens, to enable such a crane to be used on the open sea.

For achieving this object the present invention proposes a method of depositing the jib which comprises first displacing the jib to the rear and then lowering it forwards until it rests on the deck. The crane system needed for performing this method differs from the conventional rig in that the movable mast is replaced by a stationary mast. The luffing tackle now extends from the top of the main jib to the top of the mast. The bottom bearings of the main jib are located in slides adapted to be moved on rails laid in the fore and aft direction on the deck of the pontoon. Displacement of the slide is performed by tackle of which the moving ends are taken up on auxiliary drums coupled to the derrick winch. The luffing ropes are taken in as the ropes from the auxiliary drums are paid out and conversely. The arrangement thus avoids the need for additional winches and special drives. An incidental advantage of the invention is that the main jib can be locked in any desired position permitting the floating crane to be loaded and unloaded with the aid of its own rig.

BRIEF DESCRIPTION OF THE DRAWINGS

An embodiment of the invention will now be described by way of example and with reference to the accompanying drawings, in which.

DESCRIPTION OF THE PREFERRED EMBODIMENT

Figure 1:
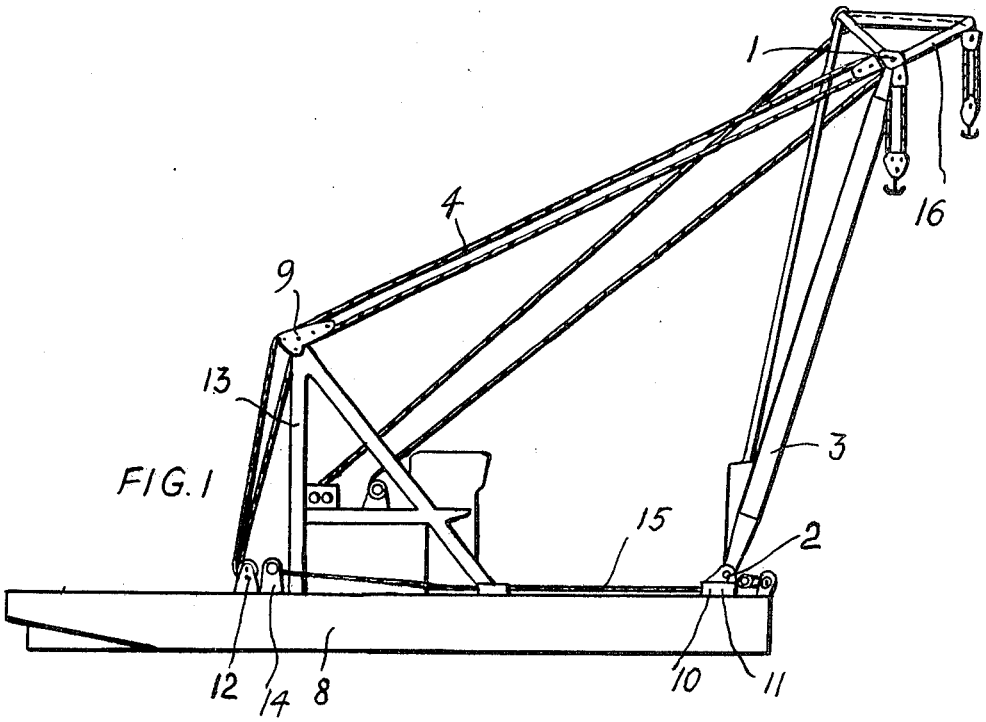
FIG. 1 is a side elevational view of a floating crane showing the main jib advanced into extreme forward position.

Referring to the drawings a floating crane 8 comprises a main jib 3 which can be luffed about a hinge 2. Luffing of the jib is done with the aid of a luffing rope 4 and a derrick winch 12. The luffing rope 4 extends from the head 9 of a fixed mast 13 to the top or head 1 of the main jib 3. The hinge 2 of the main jib 3 works in bearings 11 provided in a slide 10 adapted to move on rails on the deck of the floating crane 8 in the fore and aft direction. Auxiliary tackle 15 restrains the slide 10 when this is displaced aft and enables it to be pulled forward again.

Figure 2:
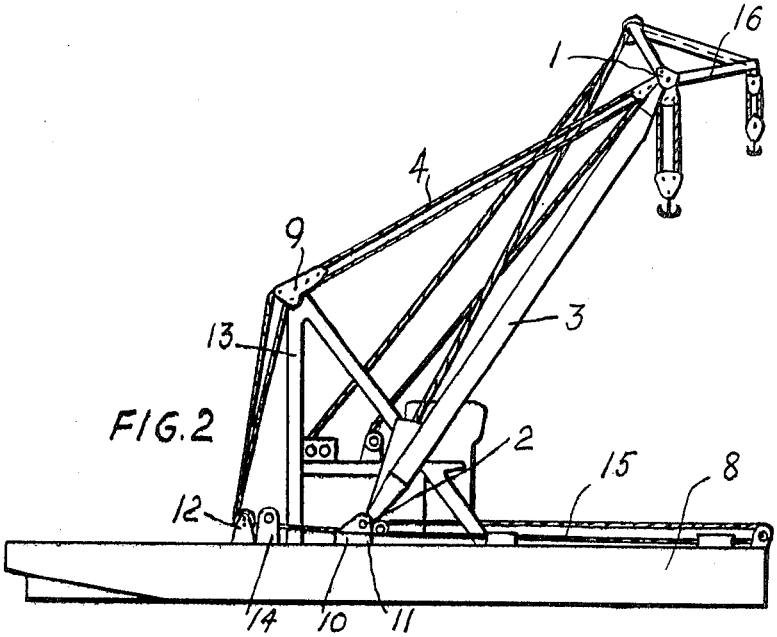
FIG. 2 is a similar view of the floating crane showing the main jib withdrawn into its extreme aft position.

FIG. 1 shows the main jib 3 in its extreme forward working position. For lowering the main jib on deck the bearings at the foot of the main jib 3 are unlocked and moved into the position shown in FIG. 2 where they are locked in position again. The main jib 3 can now be lowered and made fast on deck. It is an easy and uncomplicated operation to restore the main jib into working position by raising it.

Figure 3:
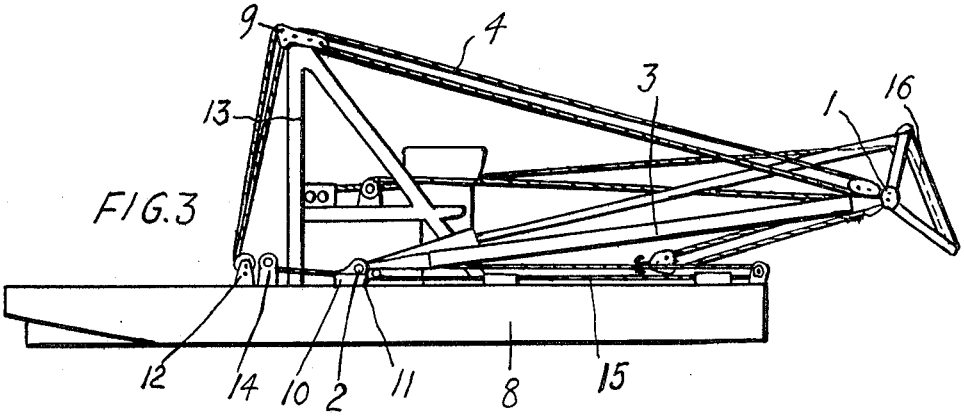
FIG. 3 is a similar view of the floating crane showing the main jib after having been lowered and resting forward on deck.

FIG. 3 shows the main jib 3 after it has been lowered. An existing top-mounting supplementary jib 16 need not be removed from the top of the main jib 3.

Figure 4:
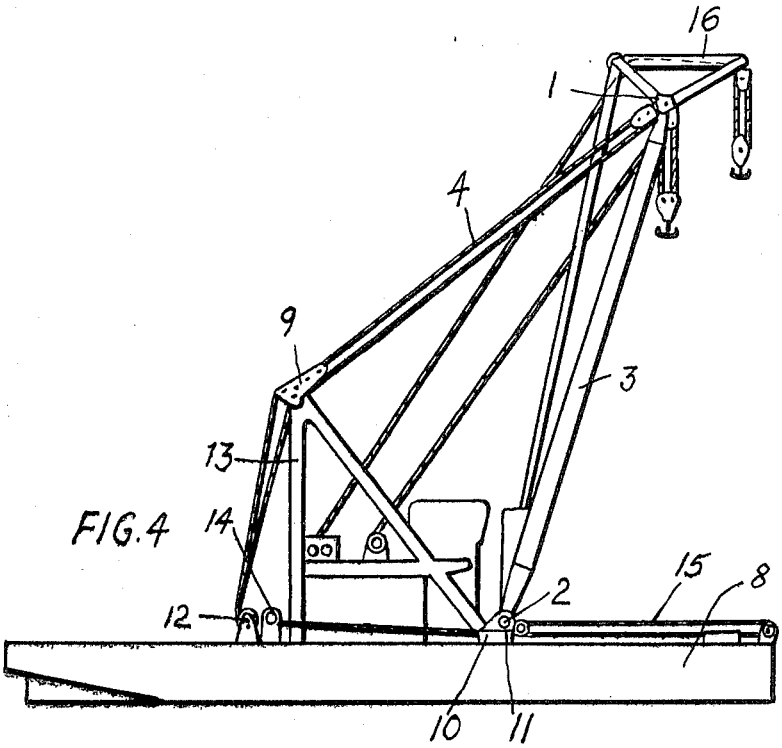
FIG. 4 is a similar view showing the main jib in an intermediate position.

In view of the special arrangement provided by the invention the main jib 3 can be moved into and locked in any intermediate position, as shown in FIG. 4. This permits the floating crane to be loaded and unloaded with the aid of its own rig.

Both rope systems 4 and 15 can cooperate to haul the main jib aft. For such a purpose the luffing ropes 4 must be taken in by the derrick winch 12 whilst the ropes of the auxiliary drums 14 are paid out. If the diameters of the derrick winch drums and of the auxiliary drums are suitably matched the main jib will move aft without changing its luffing angle.

The invention may be embodied in other specific forms without departing from the spirit or essential characteristics thereof. The embodiment is therefore to be considered in all respects as illustrative and not restrictive.

What is claimed is:

1. A crane construction having a jib adapted to be moved forwardly and rearwardly comprising a base; a fixed mast having a head; a main jib having a foot and a head at opposite ends thereof; means for guiding the foot of said jib along a path on said base extending from said mast; mounting means on said base at the end of said path opposite said mast; a derrick winch having derrick and auxiliary drums adjacent said mast; luffing tackle extending between the head of said jib, the head of said mast and said derrick drum; and auxiliary tackle extending between said mounting means, the foot of said jib and said auxiliary drum; said drums being coupled together such that the ropes of said luffing tackle are taken in as the ropes of said auxiliary tackle are paid out to move said jib rearwardly and the ropes of said luffing tackle are paid out as the ropes of said auxiliary tackle are taken in to move said jib forwardly.

* * * * *